US006269562B1

(12) United States Patent
Jacob

(10) Patent No.: US 6,269,562 B1
(45) Date of Patent: Aug. 7, 2001

(54) SHEET STRETCHING DEVICE

(76) Inventor: Daniel Jacob, 48370 Sawleaf St., Fremont, CA (US) 94539

( * ) Notice: Subject to any disclaimer, the term of this patent is extended or adjusted under 35 U.S.C. 154(b) by 0 days.

(21) Appl. No.: 09/618,841

(22) Filed: Jul. 18, 2000

(51) Int. Cl.[7] ..... D06C 3/08
(52) U.S. Cl. ..... 38/102.91
(58) Field of Search ..... 38/102.91, 102.1, 38/102.4, 102.3; 160/374.1, 376, 404

(56) References Cited

U.S. PATENT DOCUMENTS 4,106,852 * 8/1978 Chasins ..... 38/102.91 X
4,277,901 * 7/1981 Williams ..... 38/102.2
4,620,382 * 11/1986 Sallis ..... 38/102.91
5,056,247 * 10/1991 Loomie ..... 38/102.91
5,129,171 * 7/1992 Arbter et al. ..... 38/102.91
5,647,157 * 7/1997 Kasahara ..... 38/102.91

* cited by examiner

*Primary Examiner*—Ismael Izaguirre
(74) *Attorney, Agent, or Firm*—Palmer C. DeMeo

(57) ABSTRACT

An apparatus for stretching a sheet of material such as a sheet of watercolor paper utilizes a flat board and a frame assembly for bending the board into a dish shape. The board has a plurality of radially extending segments separated by radially extending slots therebetween. The board is bent into a dish shape by a mechanism attached to the frame. The sheet is then affixed to the bent board with anchors while the frame is attached to the board and subsequently the frame is released from the bent board allowing the board to resume its originally flat condition thereby resulting in the sheet being stretched.

30 Claims, 8 Drawing Sheets

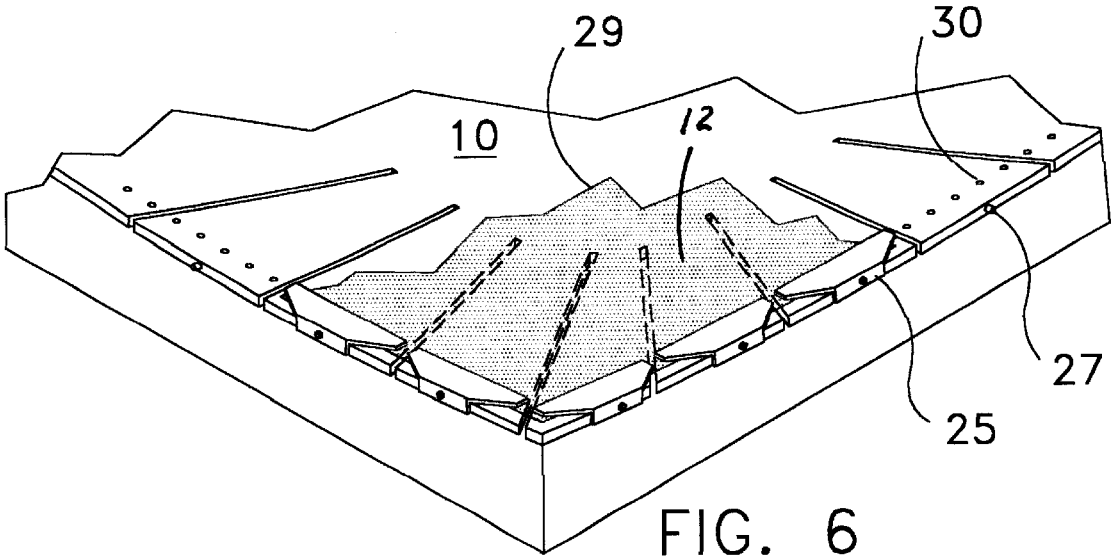
FIG. 6
FIG. 7
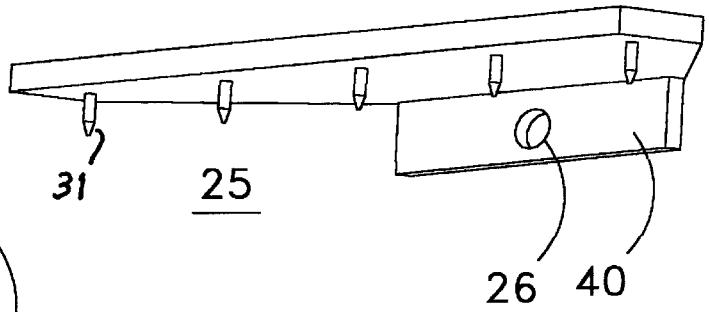
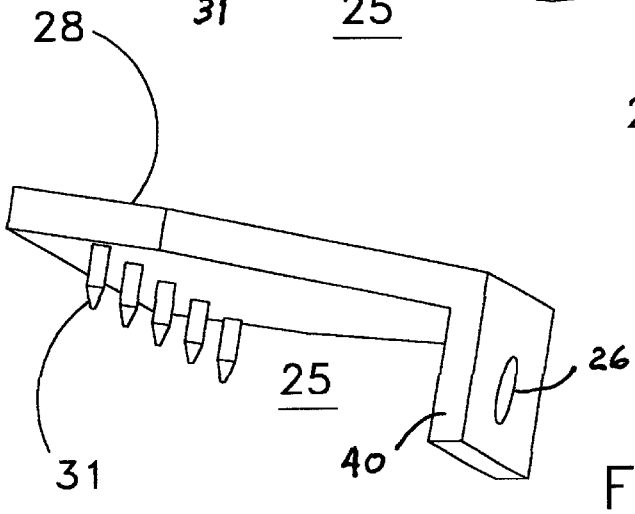
FIG. 8

SHEET STRETCHING DEVICE

BACKGROUND OF THE INVENTION

1. Field of the Invention

The present invention relates to sheet stretching devices and particularly to graphic arts paper stretching devices wherein the paper is watercolor paper.

2. Description of the Related Art

One problem encountered when painting a watercolor is when wet washes are applied to the watercolor paper, the paper expands in the wetted areas only, and as a result the paper buckles. When the paper dries the buckling does not disappear; in fact, the buckling becomes semi-permanent and can only be removed with special techniques. The buckles, in turn, result in depressions in the paper. The ridges and depressions in the paper make it difficult to control the behavior of subsequent washes. Tinted washes tend to flow away from the ridges towards the depressions causing the intensity of colors to vary in a way the artist did not intend.

When a buckled painting is finished and ready for framing, the paper must be flattened first by dampening the entire sheet and letting it dry under a flat surface such as a wooden board.

The buckling phenomenon described above occurs more noticeably with thinner papers of 140 lb and thinner. Thicker watercolor papers of 300 lb and higher do not buckle as much and are quite manageable. However, thicker papers cost more than thinner sheets thus limiting some artists in their choice of paper thickness.

The solution to buckling used by most watercolor painters is to stretch the paper on a suitable board prior to painting. The way this is normally done is to soak the entire sheet of watercolor paper with water for about five to ten minutes and allowing the paper to expand. Then the wet paper is attached to a flat board along its edges, either with staples or wetted gummed tape and left to dry for several hours or overnight. While drying, the paper contracts and becomes taught and flat on the board. Stretching the paper as described above makes the paper much less prone to buckling. Even when heavily wet washes are applied to the stretched paper, and some buckling does occur, the paper will re-assume its taught and flat condition when dry.

The process of stretching watercolor paper is time consuming and troublesome in a number of ways. For example, sometimes the gummed tape used to stretch the paper gives way to the tension applied to it by the paper and the paper has to be re-stretched. Also, removing the tape when the painting is finished may at times damage the paper in spots or leave tape residue. When using staples, some staples do not penetrate the board as intended, and must be removed and reapplied. Removing the staples after the painting is done is also time consuming. And, of course, the most time-consuming aspect of stretching watercolor paper is the time waiting for the paper to dry. Some artists overcome the problem of drying time by preparing several stretched sheets ahead of time.

To ease the problems of watercolor paper stretching several inventions have appeared. However, most of those inventions address only the problem of attaching a wetted sheet of watercolor paper to a board, and have successfully eliminated the need for gummed tape and staples for this purpose. Examples of these devices are shown in U.S. pat. No. 4,126,952, 4,277,901, and 4,862,610. These inventions, however, do not solve the problem relating to the time involved with waiting for the watercolor paper to dry in order to become taught.

Closely related to watercolor paper stretchers are canvas stretchers for oil and acrylic painting. Numerous inventions exist addressing the problem of stretching canvas on a frame. Some of these inventions could be modified to be applicable to watercolor sheets. It should be noted here that the requirements for preparing canvas for oil or acrylic painting are somewhat different from those required for preparing watercolor sheet. Oil and acrylic painters do not need a solid backing for their canvases. Most oil painters have their canvases stretched onto an open frame with no backing under the canvas. Watercolor painters, however, require a solid backing for their papers for several reasons. First, since paper will expand when wetted, paper on an open frame will tend to sag when wet washes are applied. Furthermore, watercolor painting often involves techniques such as "Lifting" and "Scratching" that require a solid backing because these operations apply significant force onto the paper surface. Therefore, frame stretchers are not quite applicable to watercolor paper stretching. Never-the-less, a discussion of frame stretchers is presented below since some of the concepts involved in frame stretchers could, perhaps, be applied to stretching watercolor paper.

One problem with many frame stretchers is that most of them stretch the canvas along two perpendicular axes by simply increasing the distance between opposing frame members. And, if the canvas is attached, for example, with staples, all along the frame members, then the canvas is restricted from stretching along the frame members because the frame members themselves do not expand. Examples of such canvas stretchers are disclosed in U.S. Pat. Nos. 4,301,853, 4,565,020 and 5,918,392. One patent that recognizes the above problem is U.S. Pat. No. 4,144660. In this patent the inventor has provided means for increasing the length of each frame member after the canvas has been attached to the frame. The inventor has done this by having each frame member consist of several segments, and providing means for increasing the space between each of the segments, thereby increasing the overall length of each frame member. U.S. Pat. No. 5,115,584 has also solved the problem of restricting the canvas from stretching along the frame members. In this patent the canvas is not attached to the frames at all. The canvas is stretched using resilient clips to stretch the canvas over the frames, but the canvas is free to stretch along the frame members. The latter two cited inventions, however, are not suitable for stretching watercolor paper since they do not provide a solid backing under the stretched sheet, something that the watercolor paper should have as explained above.

It is evident from the above that it would be highly beneficial for watercolor artists if they had a device that could stretch watercolor paper in its dry state within a matter of minutes, never having to wet it prior to stretching, nor wait for hours for the paper to dry. Furthermore, what is needed by watercolor artists is a paper stretching device that provides a solid backing under the watercolor paper. Another improvement that would benefit watercolor artists is the reduction in the time consumed by attaching and detaching watercolor paper from a board.

SUMMARY OF THE INVENTION

To overcome the shortcomings associated with paper and fabric stretchers as enumerated above, the present invention provides an apparatus and method to stretch watercolor paper in its dry state, without having to pre-wet the paper as is currently the practice.

In the present invention a paper mounting board is first bent on a special frame and assumes a dish-like shape. While the mounting board is still on the frame in its bent state, the paper is mounted onto the board and attached to its edges with a plurality of special anchoring devices. Then the board is separated from the bending frame and allowed to assume its original, flat shape. However, since the board is prevented from completely returning to its flat shape by the paper attached to it, the board consequently exerts a stretching force all around the edges of the paper that pulls the paper taught and flat. In this stretched state the paper and board are ready for the artist to paint on.

Utilizing the apparatus and method of the present invention, artists can stretch their watercolor paper within a matter of minutes in contrast to the hours they must currently wait for their pre-wetted paper to dry.

Another improvement provided by the present invention are the means whereby the paper is attached to the mounting board. The common practice among watercolor artists is to attach their paper to a mounting board using either a large amount of staples or lengths of gummed paper tape, both methods requiring lengthy times for attaching and detaching the paper to and from the board. The present invention provides special anchors for attaching paper to a board, each anchor taking the place of five or more staples so that the times involved attaching and detaching the paper are greatly reduced.

It is therefore an object of the present invention to provide a watercolor paper stretching board that is capable of stretching watercolor paper in its dry state.

It is a further object of this invention to provide a watercolor stretching board that will stretch the watercolor paper substantially radially, so that it is stretched in all directions simultaneously.

Yet another object of the present invention is to provide time-efficient means for attaching and detaching watercolor paper to and from a board.

BRIEF DESCRIPTION OF THE DRAWINGS

FIG. 6 is a partial perspective view showing the top of the board with paper attached to it with anchors.

FIGS. 7 and 8 are perspective views of the anchors used to secure watercolor paper to a board.

DESCRIPTION OF THE PREFERRED EMBODIMENTS

In order to facilitate an understanding of the various elements of the present invention, the principle of its operation is described first.

Let us take a flexible object shaped like a shallow dish and cut several thin slots in it starting from its rim and up to its base. If we then flatten this object, say by placing a transparent sheet of glass on top of it, we would see right away that the outer periphery of the flattened dish-like object would be significantly longer that the periphery of the original rim.

Now let us say that prior to flattening the dish-shaped object we covered its opening by gluing a thin, round sheet of rubber along its rim. If we then place our glass plate over the assembly and flatten it, we would of course notice that the rubber sheet has stretched evenly and radially in all directions.

This is the geometric phenomenon employed in the present invention for stretching a sheet of material such as watercolor paper. However, the logic followed here is somewhat reversed: We start out with a flat board in which slots are cut, then force the board into a dish-like shape, then attach the sheet to be stretched onto the periphery of the board, and then just let the board seek its original, flat state while stretching the attached sheet along with it. The slots in the board essentially create peripheral space so that the periphery of the board is allowed to contract freely while the board is forced into a dish-like shape.

Although the following detailed description depicts the stretching of watercolor paper, it should be understood that a sheet of any material, including fabrics, plastic and canvas, may be stretched in a similar manner.

Figure 1:
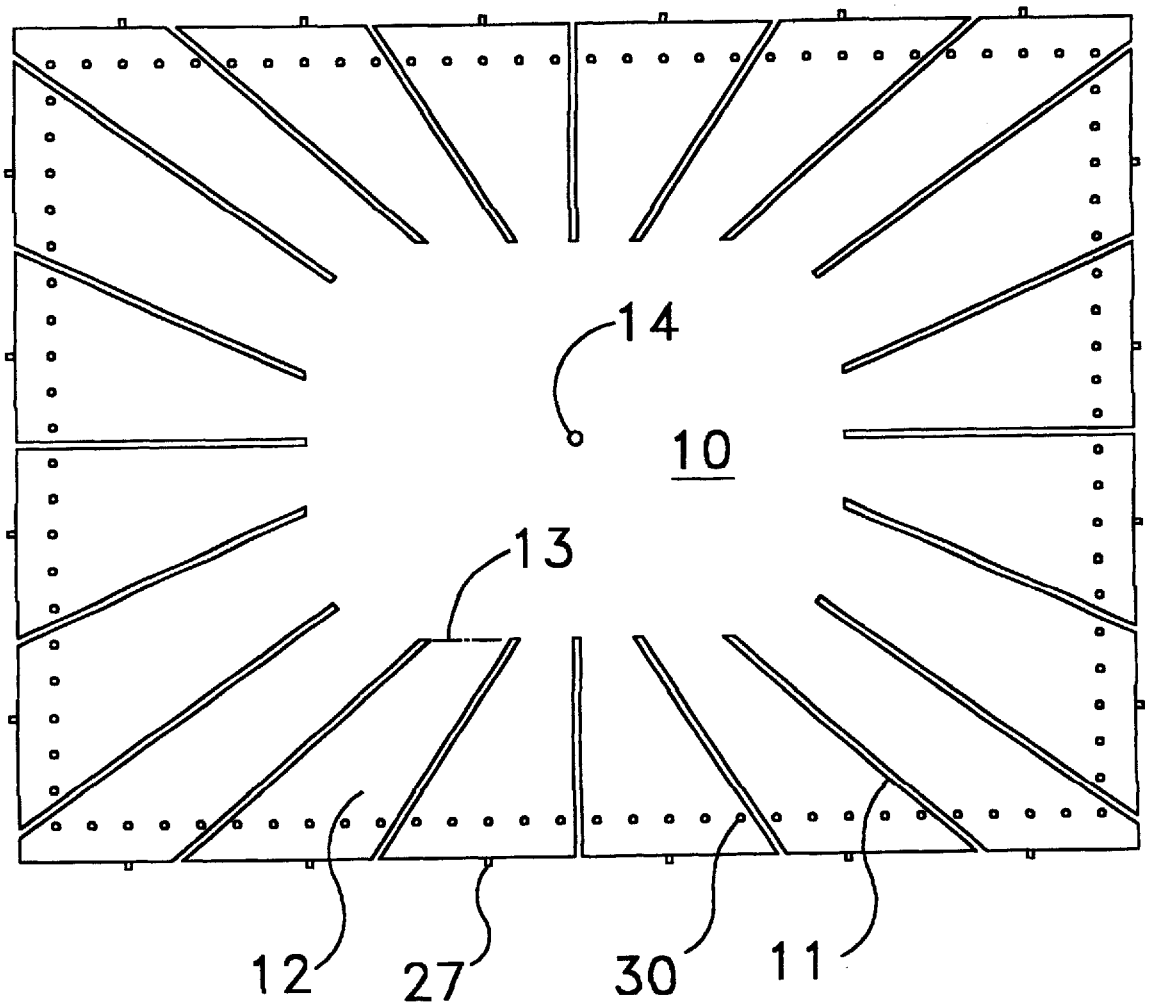
FIG. 1 is a top view of the watercolor paper board employed in the preferred embodiment of the present invention.

FIG. 1 shows a top view of the preferred embodiment of a board 10. The board is designed to stretch watercolor paper as well as to hold it stretched until the painting is finished. The board 10 shown is for a full watercolor paper sheet which is 22×30 inches. The board 10 may be constructed from any number of flexible materials such as plywood, plastic, aluminum, or foam board. Board 10 is 1 inch longer and 1 inch wider than a full watercolor paper sheet.

Board 10 is provided with a number of slots 11. The outer ends of slots 11 are equally spaced around the periphery of the board, and the direction of the slots are substantially radial, pointing towards the center of board 10. The number of slots 11 and their length may be varied depending on requirements such as paper tension, paper thickness, board material and so on. Those skilled in the art will realize that the longer the slots, the less force will be required to bend each segment of the board 10 between the slots 11. Experiments with ¼ inch thick plywood boards have shown that for a 22×30 inches, 140 lb (a measure of sheet thickness) sheet, twenty slots are sufficient. The width of the slots 11 is kept to a minimum so that the slots 11 are not noticeable to the artist while painting. The maximum width of the slots 11 should be about one tenth of an inch, and the minimum about one sixteenth of an inch to allow for the peripheral contraction of the board 10. Each segment 12 of the board 10 between two slots 11 acts more or less like a cantilevered beam. When the board 10 is forced into a dish shape, each segment 12 bends along the line 13 drawn between the inner ends of the slots 11 bordering the segment 12. The length of bending lines 13 determines the bending strength of each segment 12. The length of lines 13 may be varied from segment to segment in order to optimize the bending strengths of the various segments 12. The center of board 10 is provided with a threaded hole 14. A metal threaded insert with a ¼"-20 thread is recommended. Further details of the board will be discussed later.

How the board 10 is forced into a dish shape will now be explained with reference to FIGS. 2–6.

Figure 9:
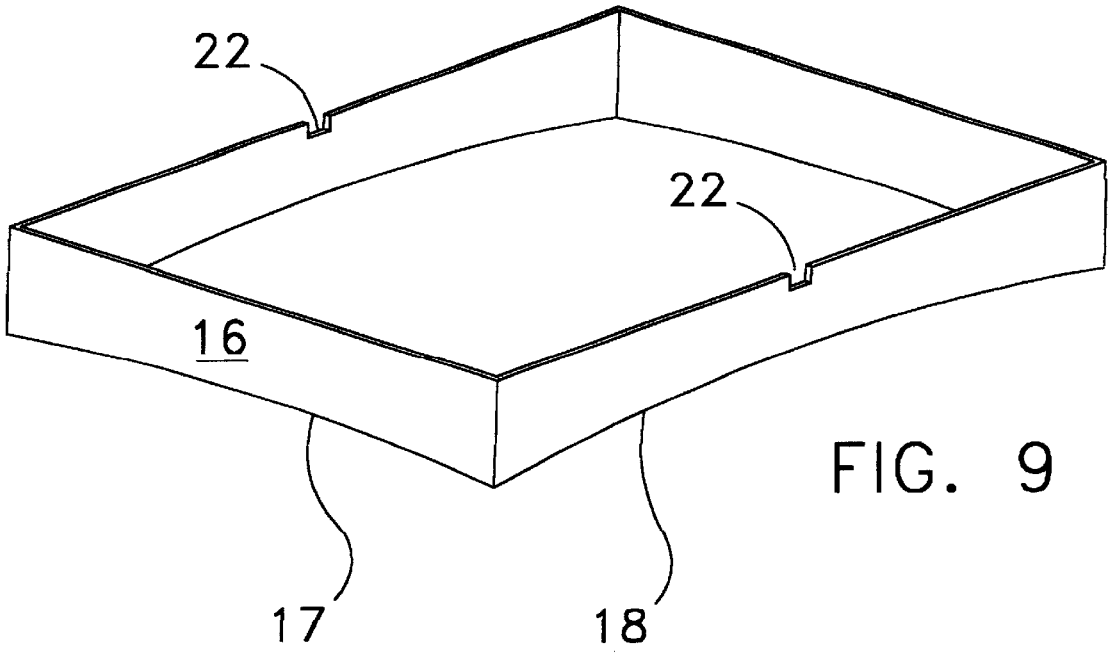
FIG. 9 is a perspective view of the frame used to bend the watercolor board.

Frame 16 (shown by itself in FIG. 9) serves as a fixture on which board 10 is bent. Frame 16 has four sides with bottom edges 17 and 18 curved in order to assist in the shaping of board 10 into a dish shape. The top edges of the four sides are straight and have a notch 22 cut into each of its longer sides. These notches 22 serve as guides for positioning a crossbar 19.

Figure 2:
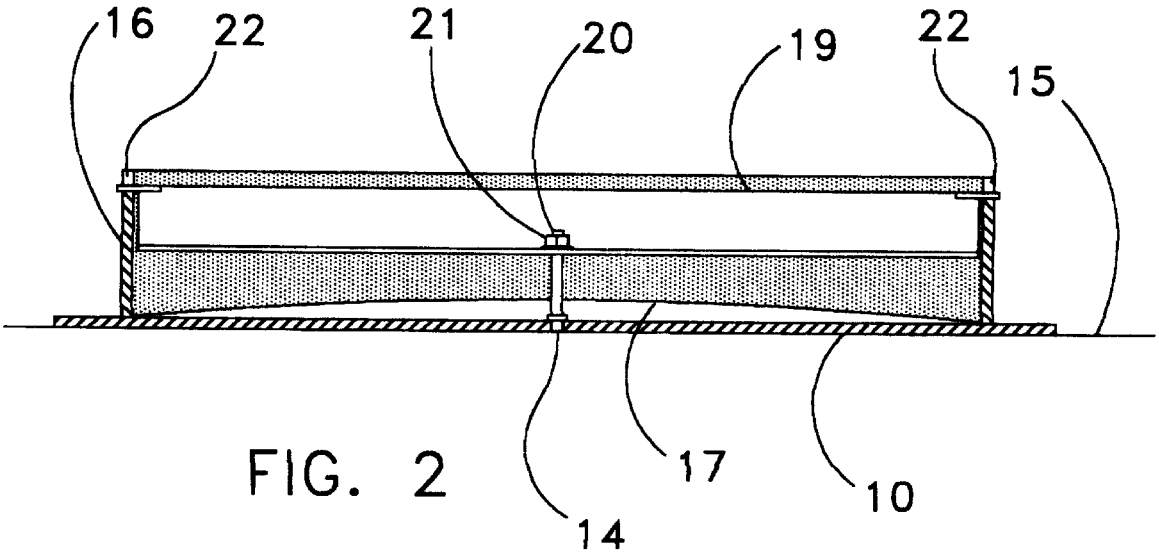
FIG. 2 is a cross-sectional view of the frame and crossbar used for bending the board.
Figure 3:
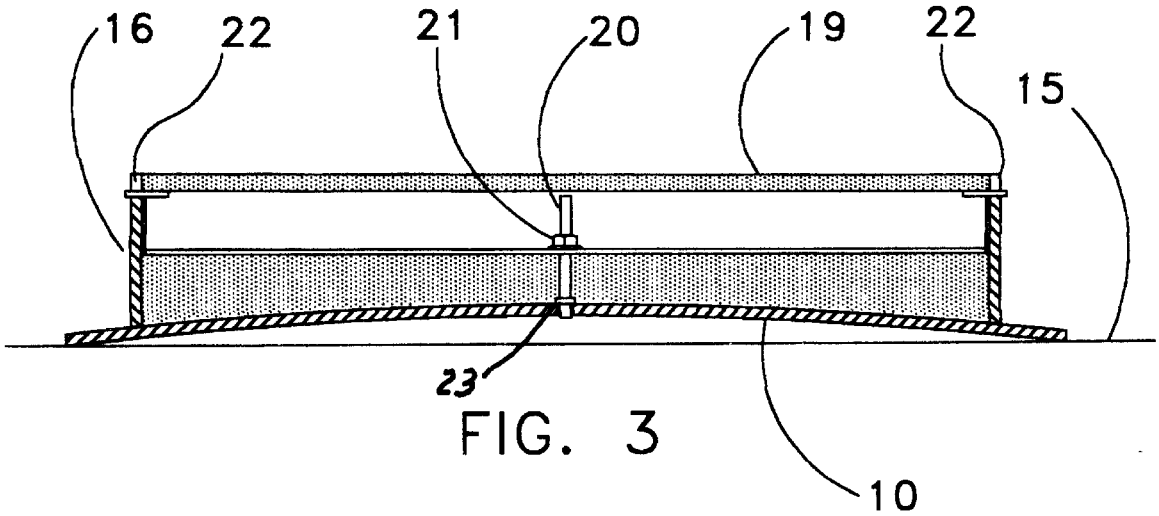
FIG. 3 is the same view as FIG. 2 with the board shown in its bent state.
Figure 4:
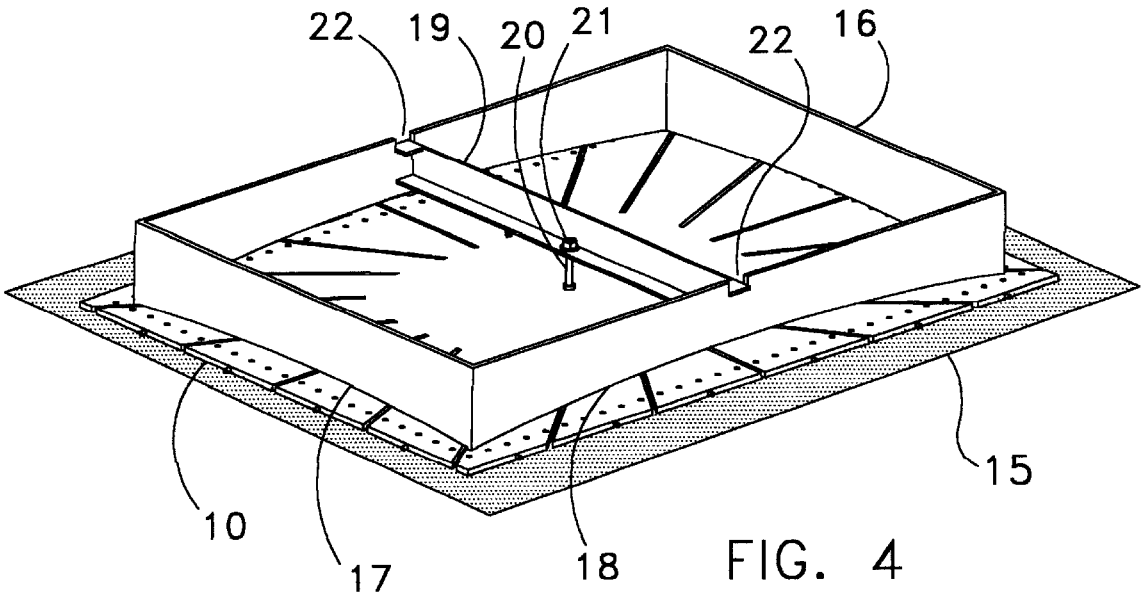
FIGS. 4 and 5 are perspective views corresponding to FIGS. 2 and 3.
Figure 5:
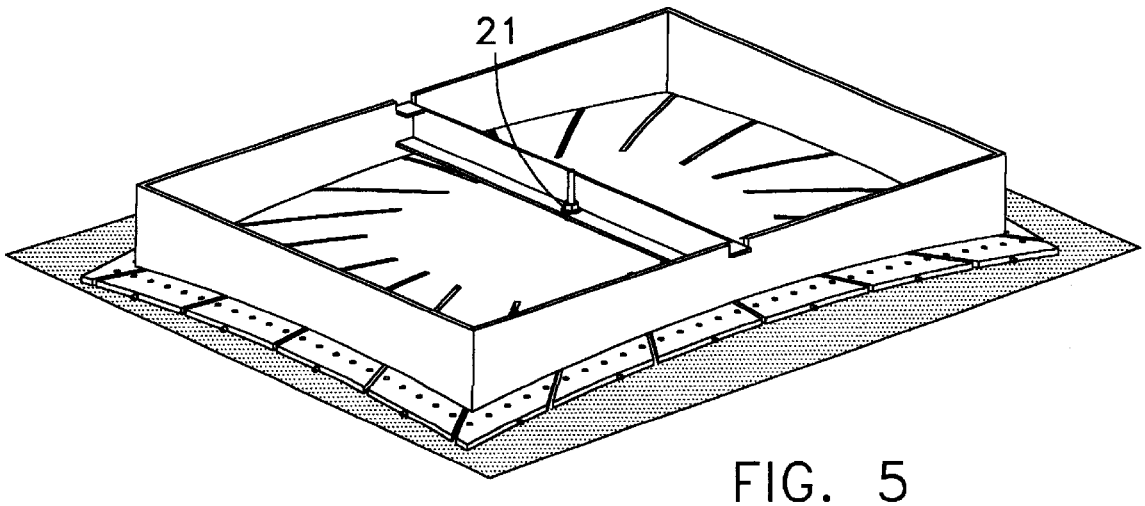
Figure 10:
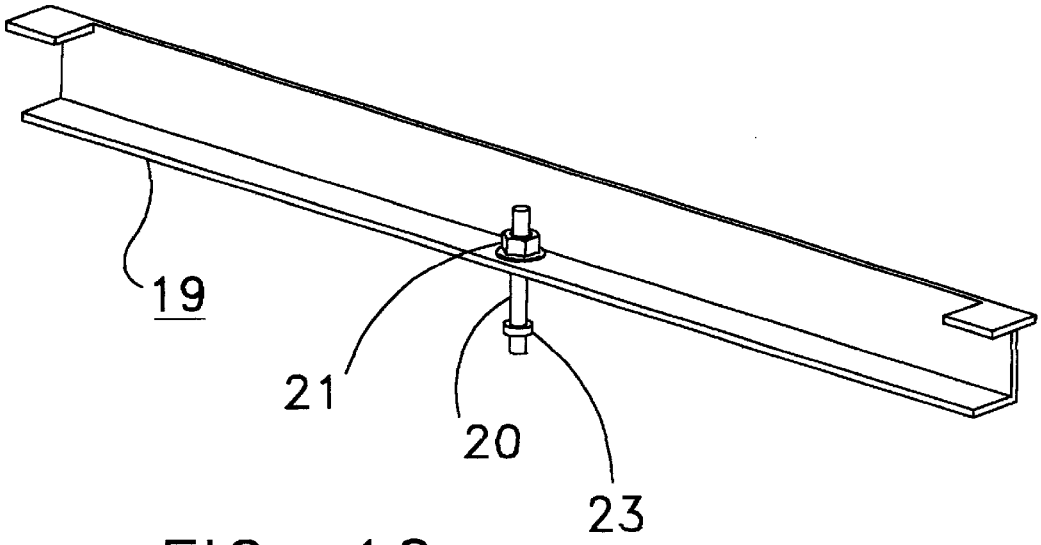
FIG. 10 is a perspective view of the crossbar and screw used to bend the watercolor board.

Referring now to FIGS. 2 and 4, board 10 is placed upon a flat surface 15. Frame 16 is placed centered atop board 10 with curved edges 17 and 18 facing down. Crossbar 19 along with screw 20 and nut 21 (shown as an assembly in FIG. 10) is placed into slots 22 in frame 16. Screw 20 is engaged into threaded hole 14 until ring 23 prevents further engagement. Nut 21 is then turned clockwise, causing screw 20 to pull the center of board 10 upwardly towards crossbar 19. As screw 20 is turned further, since frame 16 prevents the edges of board 10 from moving upwardly, board 10 is forced into assuming a dish-like shape as shown in FIG. 5. The amount of curvature of board 10 is easily controlled by how many turns are imparted to screw 20. FIGS. 4 and 5 show perspective views corresponding to the sectional views of FIGS. 2 and 3. After board 10 assumes the desired curvature, the whole assembly is turned upside down and is now ready to receive the sheet of watercolor paper.

Referring to FIG. 6, a sheet of watercolor paper 29 is placed onto the board 10 and is centered on it. Anchors 25 are attached to the board and paper simultaneously, one anchor to each segment 12 of the board 10. First the anchor guiding holes 26, shown in FIG. 7, are registered in precise position by barbs 27 in the board. The front section 40 of anchors 25 are registered against the outer edges of board 10 . This precise registration assures that the anchor barbs 31 will enter holes 30 in the board 10 which holes 30 cannot be seen when covered by paper 29. Then the top sections 28 of anchors 25 are pressed downwardly causing barbs 31 to penetrate paper 29 and to enter holes 30 in board 10.

Figure 11:
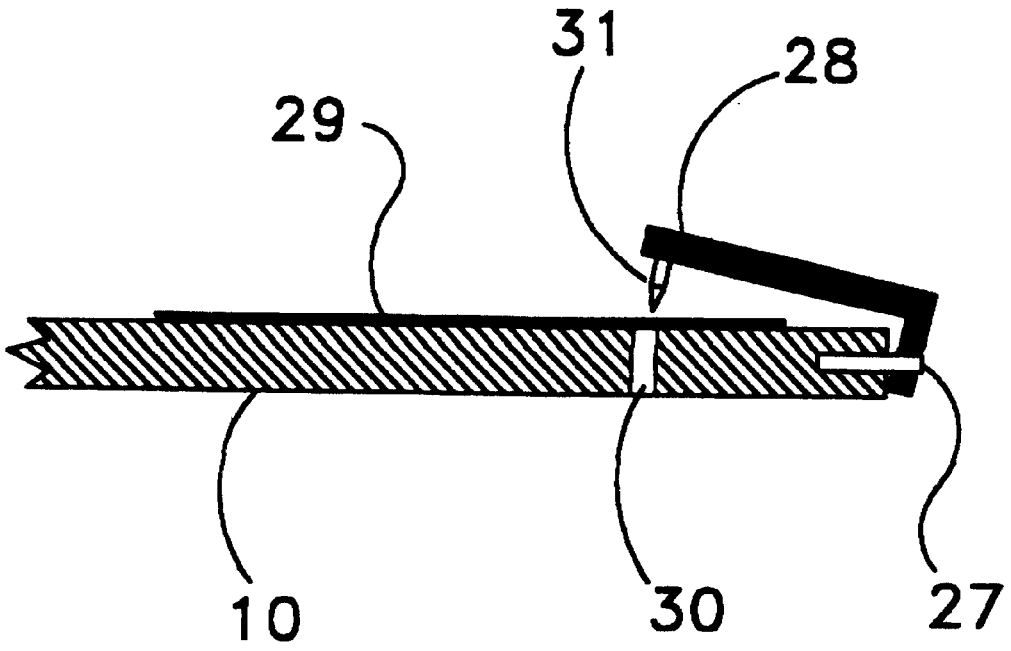
FIG. 11 is a cross-sectional view of an anchor just prior to engaging the watercolor paper.
Figure 12:
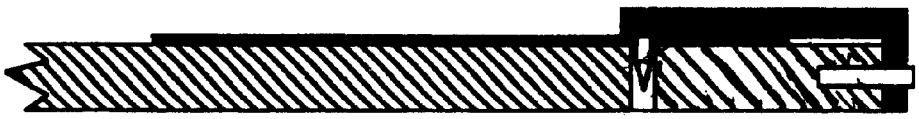
FIG. 12 is a cross-sectional view of an anchor after it has pierced the paper.

Barbs 27 serve an additional function which is to prevent the anchors 25 from disengaging from the board 10 when the stretched paper 29 pulls on the anchors 25. FIG. 11 is a cross-sectional view of an anchor 25 just prior to being pushed through the paper 29 and FIG. 12 shows the anchor 25 after it has been pushed through.

In the preferred embodiment of the present invention the board 10 accommodates a full, 22×30 inch watercolor paper sheet 29. Twenty anchors 25 are used to secure the paper sheet 29 to the board 10, each anchor 25 having five barbs 31. This means that a total one hundred barbs 31 are used to secure the paper sheet 29. Board 10 has one hundred holes 30 that accept the anchors 25. The diameter of each hole 30 in board 10 is slightly larger that the diameter of a barb 31 in an anchor 25.

Other embodiments of the present invention may not require anchors or predrilled holes in board 10 as described above. In these other embodiments paper 10 may be attached with staples, adhesive tape, or wetted gummed tape as mentioned previously. It should be noted, however, that if adhesive tape or wetted gummed tape is employed, they should not span the slots 11 in board 10 so that each board segment 12 remains free to seek its original, flat state. The tapes could be applied one piece per board edge, and then cut between board segments 12.

After all the anchors 25 have been applied to the board 10, screw 20 is turned counter-clockwise until board 10 is free from frame 16. In its free state board 10 will tend to resume its original, flat condition, and this tendency provides the radial forces that stretch the paper sheet as previously described.

Board 10 may be used to stretch and hold watercolor paper sheet 29 without using the technique described above, but by simply pre-wetting the paper sheet 29 as is normally done to this day. Anchors 25 may be used to secure the wetted paper sheet 29 to the board 10 and indeed would save the time and trouble of stapling or taping the edges of the paper sheet 29 as described above.

It should be understood that using a screw and nut system to force the board 10 to assume a dish shape is only one way of many that could be employed to achieve the same result. This point is emphasized here that the method of bending board 10 is secondary to the novelty of the present invention. It is the construction of the board 10 itself that affords this invention a unique method of stretching watercolor paper, canvas, and the like.

The following are brief descriptions of other methods and systems that could be employed for bending board 10.

Vacuum System

With slight modifications to the preferred embodiment of the present invention, a vacuum activated board-bending device could be constructed. Using frame 16 of FIG. 9 and attaching a bottom to its straight edges and a continuous rubber seal to its curved edges would create a vacuum box. A hole in the side of the frame 16 is drilled to receive a vacuum hose. The threaded hole 14 is eliminated.

Board 10 of FIG. 1 is modified by taping all the slots 11 so that the board is vacuum tight, but the slots 11 would be free to contract and expand. Alternatively, the entire board 10 could be covered with a flexible membrane making it vacuum tight.

The vacuum box described above is placed on a flat surface with its curved edges and vacuum seal facing upwards. The modified board is then placed on top of the box, and a normal house vacuum cleaner is used to draw a vacuum through the hole in the modified frame. The user must push downwardly on the center of the board to help establish a seal between the board and the frame. Once the seal becomes effective, the board is drawn down by the vacuum with sufficient force to bend the board.

Lever System

Figure 13:
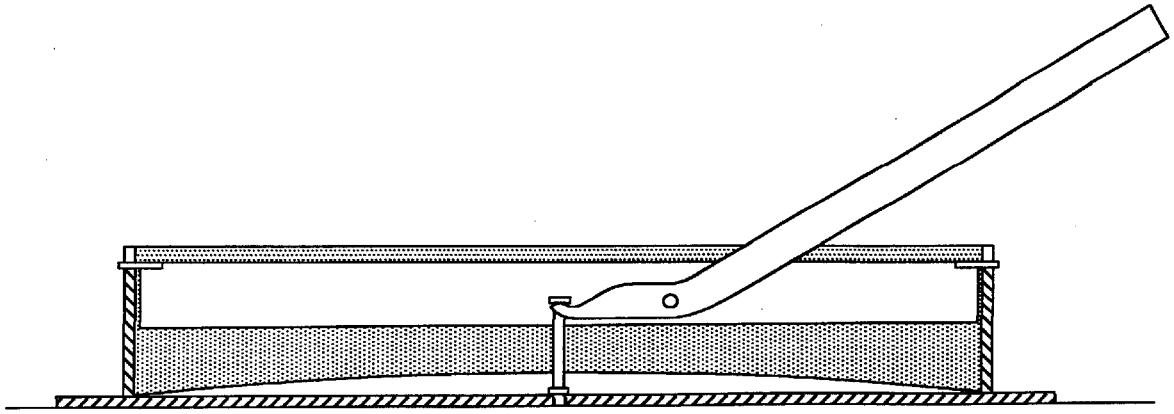
FIG. 13 shows the watercolor board being bent by a lever system.

FIG. 13 shows how a lever system could be adapted to pull the center of board 10 upwardly thus forcing the board 10 to assume a dish shape. Details of how the board 10 is held in its bent state are not given here since anyone skilled in the art of mechanical design could solve the problem.

Pulley System

Figure 14:
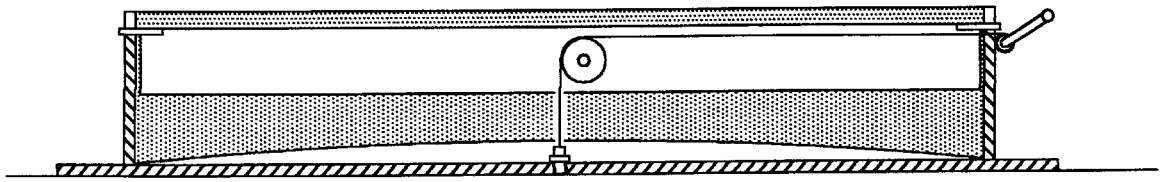
FIG. 14 shows the watercolor board being bent by a pulley and crank system.

FIG. 14 shows how a pulley and crank system could be used to perform the same function as screw 20 and nut 21 does in the preferred embodiment of the present invention.

Figure 15:
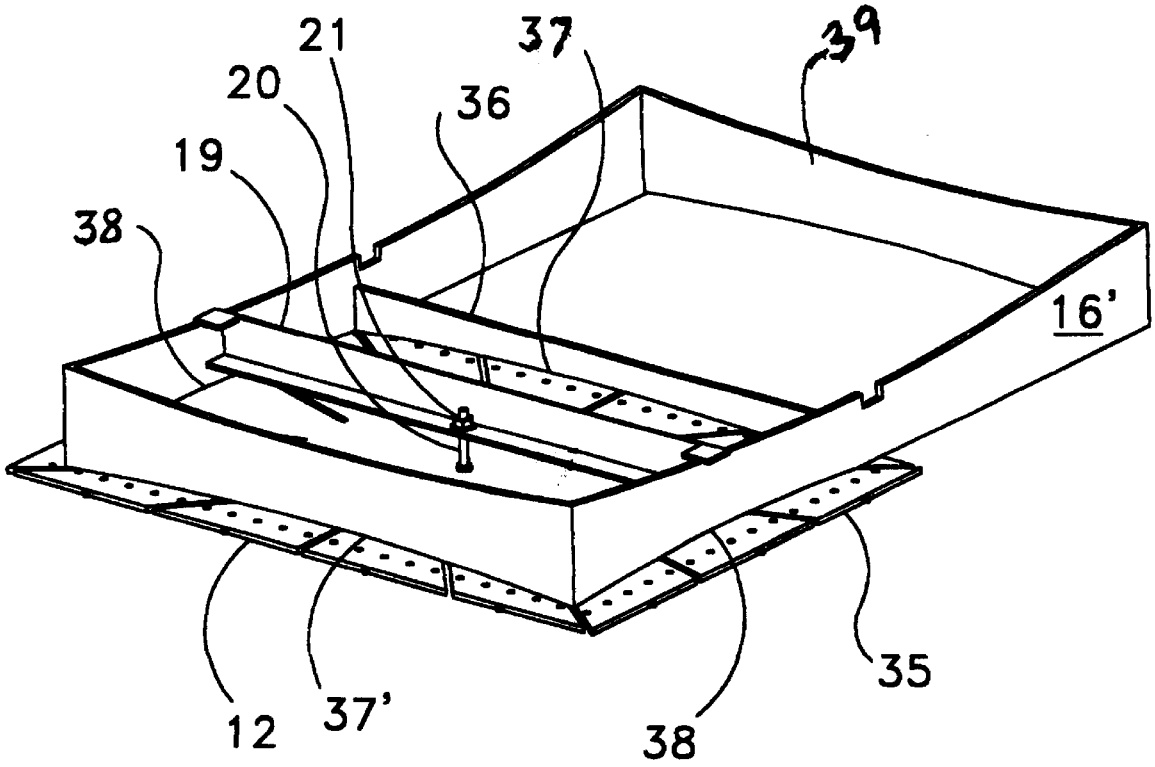
FIG. 15 shows how the frame is modified to accept a half sheet of watercolor paper.

As mentioned above, the size of the board 10 used in the preferred embodiment of this invention is for a full watercolor paper sheet, namely 22×30 inches. Often, however, a half sheet is also used by watercolor painters. FIG. 15 shows how frame 16 can be modified to 16' to accommodate a half sheet as well.

The modifications required are:

1. Plate 36 is added to support the long edge of board 35. The bottom edge 37 of plate 36 is curved to accept board 35 when it is bent. Alternatively, plate 39 of frame 16, if made removable, could be used instead of adding plate 36.

2. Frame 16' has curved side edges 37' and 38 to accept board 35 when it is bent.
3. Paper holding board 35 is added. It is inch longer and inch wider than a half watercolor paper sheet and its design features are the same as those of board 10. Because of its smaller size, board 35 has only fourteen segments 12 instead of the twenty on board 10.

Crossbar 19, screw 20, nut 21, and anchors 25 (not shown in FIG. 15) remain the same and the bending procedure as described above remains the same as well.

Frames 16 and 16' are shown in the drawings as being made from one piece of material. However, anyone skilled in the art could design frames 16 and 16' in a way that would make them more conducive to efficient packaging. For example, the frames could be hinged at the corners, or they could be attached at their corners with suitable hardware.

While an illustrative description has been given for a preferred embodiment of the present invention as well as several approaches to applying a bending force necessary for the practicability of the invention, it should be understood that different embodiments may be made using the principle of operation of the present invention. Hence, all matter disclosed heretofore is merely illustrative and the scope of the present invention is defined by the following claims.

What is claimed is:

1. A stretching device for a sheet of material comprising:

a. a substantially flat board having a plurality of through slots originating from substantially equally spaced points along the periphery of said board and terminating at points on the board that result in segments of said board residing between said through slots and said segments having predetermined, desirable bending characteristics; and b. at least one attaching means located inwardly of said slot terminating points.

2. The stretching device of claim 1 wherein said sheet of material is selected from the group consisting of paper, fabric, plastic and canvas.

3. The stretching device of claim 2 wherein said paper is watercolor paper.

4. A stretching device for a sheet of material comprising:

a. a substantially flat board having a plurality of through slots originating from substantially equally spaced points along the periphery of said board and pointing generally towards the central region of said board, said slots terminating at points on said board that result in segments of said board residing between said through slots and said segments having predetermined, desirable bending characteristics; and b. at least one attaching means located inwardly of said slot terminating points.

5. The stretching device of claim 4 wherein said sheet of material is selected from the group consisting of paper, fabric, plastic and canvas.

6. The stretching device of claim 5 wherein said paper is watercolor paper.

7. A stretching device for a sheet of material comprising: a substantially flat board having a plurality of through slots originating from substantially equally spaced points along the periphery of said board and pointing generally towards the center of said board, said slots terminating at respective points more than one quarter, but less than three quarters, the distance between the origin of said slots and the center of said board.

8. The stretching device of claim 7 further including at least one attaching means located inwardly of said slot terminating points.

9. The stretching device of claim 7 wherein said sheet of material is selected from the group consisting of paper, fabric, plastic and canvas.

10. The stretching device of claim 9 wherein said paper is watercolor paper.

11. A stretching device for a sheet of material comprising:

a. a substantially flat board having a plurality of through slots originating from substantially equally spaced points along the periphery of said board and terminating at points on said board that result in segments of said board residing between said through slots and said segments having predetermined, desirable bending characteristics;

b. at least one attaching means located inwardly of said slot terminating points;

c. a frame configured to cooperate with said board when placed on top of said board by preventing the edges of said board from moving beyond the periphery of said frame; and d. pulling means attached to said frame and removably attached to said attaching means on said board whereby the activation of said pulling means results in the movement of the central region of said board perpendicularly to the surface of said board.

12. The stretching device of claim 11 wherein said pulling means is a screw, nut, and crossbar assembly.

13. The stretching device of claim 11 further including:

e. a plurality of holes adjacent the periphery of said board;

f. a plurality of anchors each having a plurality of barbs configured to fit into said holes whereby, when said barbs penetrate said sheet of material and engage said holes, said sheet becomes anchored to the periphery of said board.

14. The stretching device of claim 11 wherein said sheet of material is selected from the group consisting of paper, fabric, plastic and canvas.

15. The stretching device of claim 14 wherein said paper is watercolor paper.

16. A stretching device for a sheet of material comprising:

a. a substantially flat board having a plurality of through slots originating from substantially equally spaced points along the periphery of said board and terminating at points on the board that result in segments of said board residing between said through slots and said segments having predetermined, desirable bending characteristics;

b. at least one attaching means located inwardly of said slot terminating points;

c. a frame configured to cooperate with said board when placed on top of said board by preventing the edges of said board from moving beyond the periphery of said frame;

d. a crossbar spanning across the top of said frame having a hole substantially at its center; and e. a screw and nut assembly attached to said attaching means on said board and passing through said hole in said crossbar so that the rotation of said nut results in the movement of the center region of said board perpendicularly to said board surface.

17. The stretching device of claim 16 further including:

f. a plurality of holes adjacent the periphery of said board;

g. a plurality of anchors each having a plurality of barbs configured to fit into said holes.

18. The stretching device of claim 17 wherein the number of said barbs corresponds to the number of said holes in an individual said segment of said board.

19. The stretching device of claim 17 further including:

h. a plurality of spaced pins protruding from the peripheral edge of said board.

20. The stretching device of claim 19 wherein each said anchor consists of:

i) a top section;

ii) a front section substantially perpendicular to said top surface;

iii) a plurality of barbs emanating from, and substantially perpendicular to, said top section, said barbs being on the same side of said top section as said front section;

iv) a guiding hole substantially in the middle of said front section whereby said guiding hole, when engaged with one of said protruding pins in the peripheral edge of said board, will align said anchor barbs with said holes adjacent the periphery of said board.

21. The stretching device of claim 16 wherein said sheet of material is selected from the group consisting of paper, fabric, plastic and canvas.

22. The stretching device of claim 21 wherein said paper is watercolor paper.

23. A stretching device for a sheet of material comprising: a substantially flat board having a plurality of through slots originating from points along the periphery of said board and terminating at points inwardly of said board that result in segments of said board residing between said through slots and said segments having predetermined, desirable bending characteristics and wherein the ends of said segments are free around the periphery of said board.

24. The stretching device of claim 23 further including at least one attaching means located inwardly of said slot terminating points.

25. The stretching device of claim 24 wherein said points along the periphery are substantially equally spaced.

26. The stretching device of claim 23 wherein said points along the periphery are substantially equally spaced.

27. The stretching device of claim 23 further including:

a. flexible means for preventing air from passing from one side of said board to the other side thereof through said slots; and b. vacuum means for bending said board whereby said bending results in said board assuming a dish shape.

28. The stretching device of claim 27 wherein said vacuum means is a vacuum box having a seal around its opening so that when said board with said flexible means is placed atop said box and a vacuum is applied to the interior of said box, the central region of said board will be pulled into said box forcing said board to assume a dish shape.

29. The stretching device of claim 23 wherein said sheet of material is selected from the group consisting of paper, fabric, plastic and canvas.

30. The stretching device of claim 29 wherein said paper is watercolor paper.

* * * * *